United States Patent [19]

Varga

[11] Patent Number: 4,499,632

[45] Date of Patent: Feb. 19, 1985

[54] CARDING ENGINE

[76] Inventor: John M. Varga, 2 Lawrence Rd., Skircoat Green, Halifax, W. Yorkshire, England, HX3 OLH

[21] Appl. No.: 433,791

[22] Filed: Oct. 12, 1982

[30] Foreign Application Priority Data

Oct. 10, 1981 [GB] United Kingdom ..... 8130666

[51] Int. Cl.[3] ..... D01G 15/02; D01G 15/16

[52] U.S. Cl. ..... 19/98; 19/99; 19/112

[58] Field of Search ..... 19/98, 99, 112, 272

[56] References Cited

U.S. PATENT DOCUMENTS

| | | | |
|---|---|---|---|
| 3,064,798 | 11/1962 | Nye et al. | 72/286 |
| 3,500,661 | 3/1970 | Köhler et al. | 66/8 |
| 3,802,223 | 4/1974 | Wright et al. | 66/8 |
| 4,219,908 | 9/1980 | Winch et al. | 19/99 |

FOREIGN PATENT DOCUMENTS

| | | |
|---|---|---|
| WO79/00983 | 11/1979 | PCT Int'l Appl. . |
| 390109 | 7/1965 | Switzerland . |
| 3173 | of 1913 | United Kingdom . |
| 1143919 | 2/1969 | United Kingdom . |
| 1390070 | 4/1975 | United Kingdom . |
| 1532667 | 11/1978 | United Kingdom . |

*Primary Examiner*—Louis K. Rimrodt
*Assistant Examiner*—J. L. Kravitz
*Attorney, Agent, or Firm*—Henry Sternberg

[57] ABSTRACT

A carding engine having a rotatable hollow carding cylinder (5). The inner surface of the cylinder is formed with a fluid-conveying pathway (18 to 21) in a pattern such that fluid circulated through the pathway will maintain the surface temperature of the cylinder substantially uniform. Means are provided for circulating fluid through the pathway in such a way that during operation the pathway is maintained full of fluid.

14 Claims, 5 Drawing Figures

CARDING ENGINE

This invention relates to a carding engine.

In the preparation of staple fibres for spinning the fibres are generally straightened by a carding process due to the action between carding elements on the surface of a rotatable carding cylinder and confronting elements on a series of flats surrounding part of the surface of the cylinder. The fibres are transferred onto the card clothing of the carding cylinder from clothing on a takerin and are taken from the carding cylinder by clothing on a doffer.

It is known that the effectiveness of the carding action is dependent on the distance between the tips of the carding elements on the main cylinder and the tips of the carding elements on the flats, the carding action improving as the distance is decreased. The settings between the main cylinder and the doffer, and between the main cylinder and the takerin are also important. It is required that for uniformity of production all settings should be maintained as constant as possible throughout operation of the carding engine.

During high speed running of a carding engine it is found that the cylinder becomes heated, often to a temperature as high as 30° C. above the ambient temperature. The flats and the bends on which the flats are supported also heat up. Initial settings between the two sets of carding elements made when these elements are at ambient temperature are made with this heating process in mind in an endeavour to achieve the optimum setting during normal running. Similar considerations apply to the settings between cylinders. However, differential expansion of the various materials involved does not make calculation of the initial settings an easy task and the establishment of an equilibrium temperature can well extend over a period of several hours during which the carding machine is not operating at its optimum setting. Difficulty may also be caused if at any time the axial edges of the cylinder become choked with material, such choking tending to cause a greater build up of heat in these areas and so causing local wire damage at the edges.

The problems caused by the heating of a carding cylinder have been recognised. Thus, WO 79/00983 describes a method whereby the effective diameter of a series of flats surrounding an arc of a carding cylinder is adjusted in accordance with the sensed temperature of the carding cylinder and also where the centre to centre distance between a carding cylinder and a takerin and/or a doffer is adjusted in accordance with the temperature of the carding cylinder. The continuous scanning of cylinder temperature, the derivation of temperature deviations from this scan and the use of those derivations to physically adjust settings of the machine lead to a complex arrangement that cannot take account of local variations of the cylinder and that may have a relatively long response time before adjustment is properly effected. The object of the present invention is to overcome the disadvantageous effects associated with cylinder heating in a simple and convenient manner.

According to the invention we provide a carding engine having a rotatable hollow carding cylinder, bends at each side of the cylinder, flats supported by the bends and cooperating carding elements on the flats and on the outer surface of the cylinder, in which a fluid-conveying pathway is formed on the inner surface of the cylinder in a pattern such that fluid circulated through the pathway will maintain the surface temperature of the cylinder substantially uniform.

By circulating fluid over the inner surface of the cylinder, differential heating of the cylinder surface is avoided as local build-ups of heat are dissipated by the circulating fluid. The temperature of the fluid can be controlled, for example by a heat exchanger at some convenient point in the fluid circuit or by using the whole cylinder mass possibly together with other parts of the carding engine as a heat sink, to hold the fluid and thus the cylinder at a substantially constant temperature during operation of the carding machine. The initial settings between the carding cylinder and the flats, and between the carding cylinder and other cylinders cooperating therewith, can thus be set in the knowledge that there will be a constant operating temperature and accordingly very small operational settings can be achieved.

In normal operation of a conventional carding engine it is found that the heat build-up due to friction in the cylinder, bends and flats area results in a cylinder temperature of some 5° to 10° C. above ambient temperature, the temperature at the axial edges of the cylinder being higher than at the centre of the cylinder. In some cases the cylinder temperature may reach even higher figures. In one embodiment of the invention the fluid is heated to raise the temperature of the cylinder above the normal expected maximum working temperature, for example to a temperature of from 20° to 30° C. above ambient temperature. By designing all settings for operation at the selected temperature and rapidly bringing the cylinder to that temperature either before or during start-up of the carding engine it will be seen that the card is very rapidly stabilised to run at optimum settings. Alternatively, and preferably, the circulating fluid may be used to cool the cylinder below its normal operating temperature, desirably to ambient temperature, and particularly to carry heat more rapidly from those areas of the cylinder where greater heating occurs.

The pathway forms at least one continuous fluid path having a discrete inlet and a discrete outlet at opposite extremities thereof; the pathway may desirably be in the form of a single continuous fluid path. The pathway, the circulating means and the fluid are preferably such that, during operation, the pathway is maintained full of fluid at all times. It is important for optimum carding that the cylinder of a carding engine run in a balanced condition and accordingly any air-locks that occur in the circulation path of the fluid can potentially throw the cylinder out of balance and adversely affect the running of the card. Use of continuous fluid paths helps to mitigate the possibility of air-locks occuring. It also helps if the fluid is supplied under significant positive pressure and if means are included in the fluid supply circuit to remove air bubbles from the fluid. The fluid should desirably also remain under pressure even when the carding engine is stationary, and a gravity reservoir may be included in the fluid circuit to maintain such pressure. Additional sealing means may be included to facilitate this.

The cylinder may have a fluid-conveying pathway formed or incorporated in its surface thickness. More preferably, however, channel sections are secured to the inner surface of the hollow cylinder, for example by welding, the channels defining the fluid pathway. In one preferred arrangement the pathway is formed by a plurality of parallel, axially spaced channels each extending around the full inner circumference of the cylinder, with transfer means communicating between adjacent channels. Alternatively, the pathways could be formed by a single-start or multi-start helical channel construction extending around the inner surface of the cylinder. In a further alternative the pathway may be formed by paths extending axially of the cylinder from one end to the other thereof, individual paths intercommunicating at respective ends of the cylinder. It is not necessary to expose the whole internal surface of the cylinder to the circulating fluid, although this can be done using either circumferentially or axially extending paths. It will suffice if any point on the surface of the cylinder is no more than a set maximum distance from a fluid channel, the maximum distance being derived having regard to the thermal conductivity of the cylinder. Generally speaking the maximum distance should not be more than 12.7 cm (5 inches)

Fluid may also be circulated through a fluid-conveying jacket on each bend of the carding engine in order to keep the bends at substantially the same temperature as the cylinder. In carding engines it is generally the relative setting between the surface of the bends and the surface of the tips of the carding elements on the cylinder that determines the setting of the carding elements on the flats from those of the cylinder. Thus, if the bends and the cylinder are controlled to expand and contract together and are maintained at substantially the same temperature very accurate settings can be achieved and maintained. Fluid may also desirably be circulated to the fluid-conveying sections of the main frame of the card at each side thereof, as the settings between the frame and the cylinder and between the cylinder and the doffer and takerin can also be important to efficient running. The fluid-conveying jackets and sections are preferably in series with the fluid-conveying pathway of the carding cylinder, desirably downstream thereof, or can be on a separate circuit from the fluid circuit of the carding cylinder, the fluid in the two circuits being controlled to be at the same temperature. In the former case it will be seen that the cylinder, bends and frame act as a common heat sink and radiator, this being the most effective way of maintaining the required areas of the carding engine at uniform temperature. Fluid may also be circulated along associated or independent pathways to any other areas of the carding engine where differential heat build-ups and potential expansion problems are present, or areas where local temperature rises may occur.

In order that the invention may be better understood a specific embodiment of the carding cylinder of a carding engine will now be described in more detail, by way of example only, with reference to the accompanying drawings in which.

Figure 1:
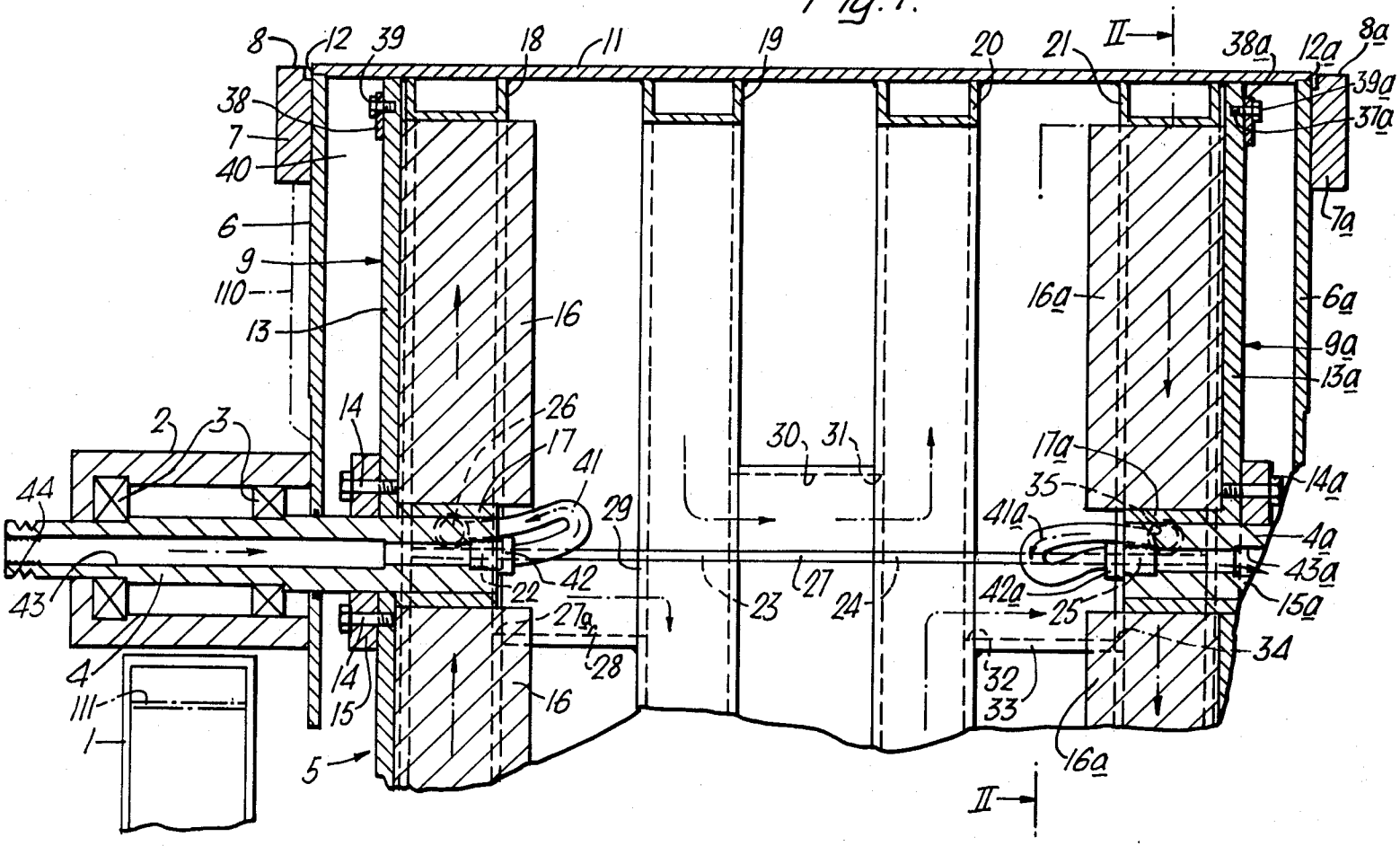
FIG. 1 is an axial cross-section through the carding cylinder of a carding engine.
Figure 2:
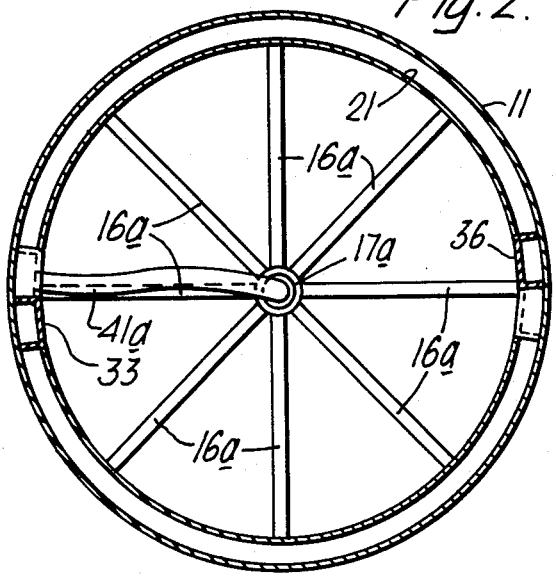
FIG. 2 is a reduced scale section on the line II—II of FIG. 1.
Figure 3:
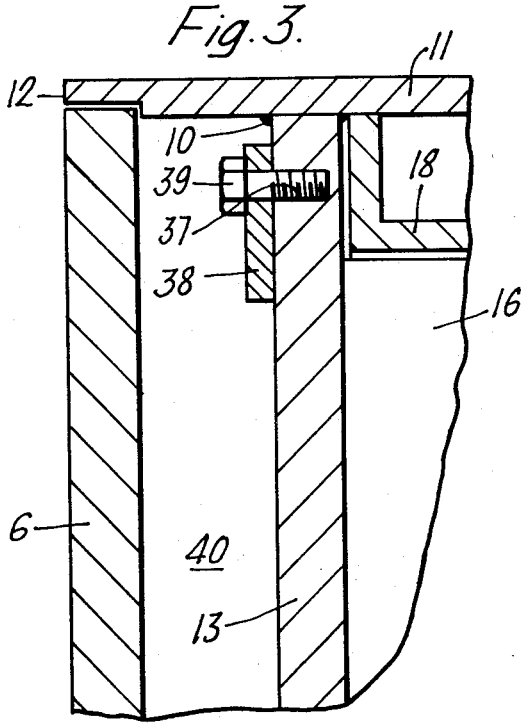
FIG. 3 is an enlarged detail view of part of FIG. 1.

Referring now to FIG. 1 a frame (of which only a lower part is shown) of a carding engine supports at each side of the carding engine a bearing housing 2 in which is mounted a bearing assembly 3 supporting for rotation a stub shaft 4 of a main carding cylinder indicated generally at 5. The bearing housing carries a bend 6, and members 7 providing a bearing surface 8 for flats (not shown) are secured to the bends 6 in any convenient manner. The construction at the opposite side of the carding engine is similar and corresponding parts are designated by the same reference numeral with the suffix a. The card frame and bearing housings are shown in somewhat stylised form as full constructional details of the carding engine play no part in the invention, which is applicable to cards of many different types of construction.

The cylinder 5 is symmetrical about its radial central plane and comprises at each side a spider shown generally as 9, 9*a* to the circumferentially outer surfaces of which is secured a hollow cylindrical member 11. Axially outer extremities 12, 12*a* of the member 11 are recessed to lie over and closely adjacent to the respective bends 6, 6*a*. Each spider comprises a disc 13, 13*a* secured by bolts such as 14, 14*a* to a flange 15, 15*a* welded to the respective stub shaft 4, 4*a*. Each disc 13, 13*a* is reinforced by radially extending ribs 16, 16*a* respectively, the ribs being welded to the respective disc and to a boss 17, 17*a* extending axially inwardly from the disc.

The inner surface of the cylinder is furnished with fluid-conveying pathways formed by four parallel, axially spaced channels 18 to 21 each extending around the full inner circumference of the member 11. Each channel is interrupted by a baffle 22 to 25 respectively extending transversely of the channel. Each channel is formed by a channel section member welded to the member 11, and the baffles are also welded to the member 11 and to the channel ends, the baffles forming part of a continuous rib 27 extending the length of the cylinder between the two spiders. The channel 18 is formed with a threaded inlet 26 to one side of the baffle 22. On the other side of the baffle 22 the axially inner channel wall is cut away at 27*a* to form an outlet from the channel 18, the outlet opening into a transfer channel 28 formed by a further channel section member and extending axially of the cylinder between the channels 18 and 19. The transfer channel 28 communicates with an opening 29 into the channel 19 at one side of the baffle 23. In a similar manner the channel 19 terminates to the other side of the baffle 23 and transfer channel 30 extends from there to an inlet 31 into the channel 20. An outlet 32 from the channel 20 is connected by a transfer channel 33 to an inlet 34 into channel 21, which is formed with a threaded outlet 35 to the opposite side of the baffle 25. There is thus defined a single continuous fluid path extending from the inlet 26 around the full circumferential length of the channel 18, through the transfer channel 28, around the full circumferential length of the channel 19, through the transfer path 30, around the full circumferential length of the channel 20, through the transfer path 33, around the full circumferential length of the channel 21 and terminating at the outlet 35 from that channel.

For a carding machine to run most efficiently it is necessary that the main cylinder be properly balanced. Accordingly, in order to balance the weight of the elements forming the transfer channels 28, 30 and 33 corresponding dummy channels such as 36 are welded to the cylinder inner surface diametrically opposed to the transfer channels. Additionally, tapped holes 37, 37*a* may be provided at intervals around the spider dics to which balance weights such as 38 may be secured by bolts 39, 39*a*. Balance weights of appropriate value are secured at the angular locations necessary to achieve balance of the cylinder.

Figure 4:
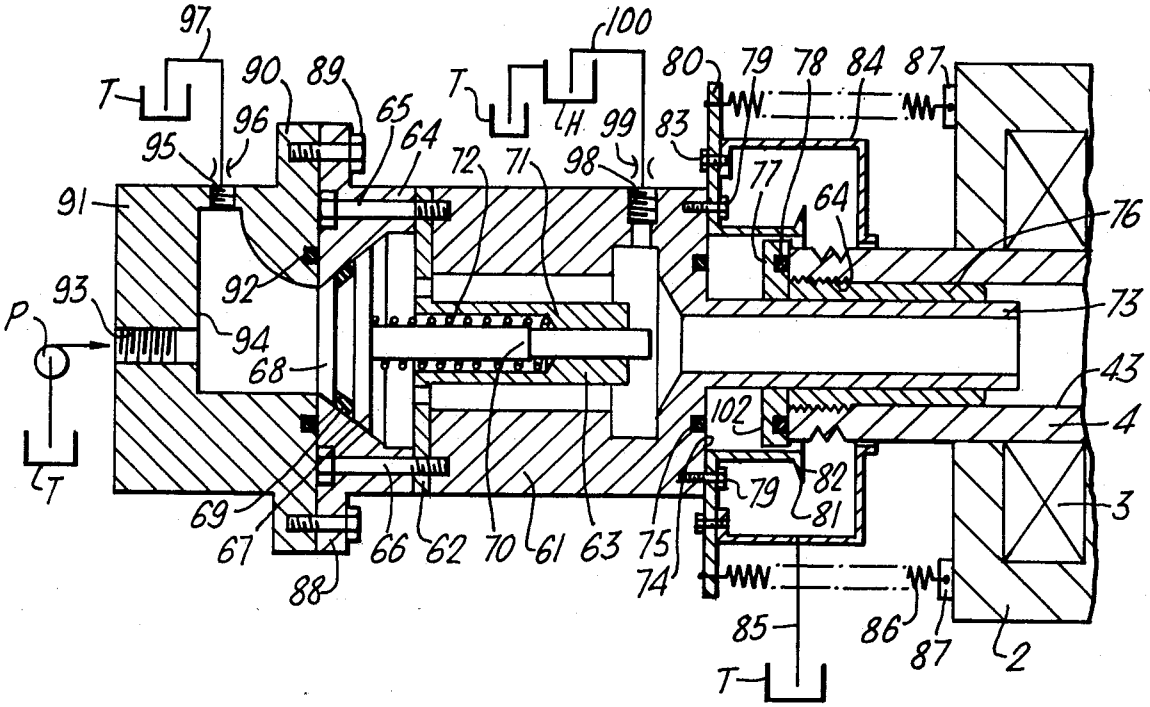
FIGS. 4 and 5 show respectively inlet and outlet valves and associated schematic details of an hydraulic circuit.

On assembly of the carding engine the fluid inlet 26 into the channel 18 is joined by a connector and flexible hose 41 to a threaded connection 42 at the axially inner end of an axial bore 43 through the stub shaft 4. The bore 43 also has an axially threaded outer end 44. The outlet 35 from the channel 21 is similarly connected by a hose 41*a* and connector 42*a* to a bore 43*a* through the stub shaft 4*a*. The bore 43 thus forms an inlet into the fluid-conveying pathways, and the bore 43*a* an outlet from those pathways. Inlet and outlet valve assemblies are associated with the shafts 4 and 4*a* respectively, those assemblies being shown in FIGS. 4 and 5. The valve assemblies form part of an hydraulic circuit that incorporates a common drain and supply tank T below the level of the carding cylinder, a header tank H above the level of the carding cylinder and a pump P. The circuit may include heat exchange means at some convenient part thereof, possibly in the tank T, but more preferably the cylinder and other parts of the carding engine are used as a heat sink and radiator.

The inlet valve assembly comprises a valve body 61 to which a disc 62 supporting a guide 63 and an end plate 64 are secured by bolts 65, 66. The end plate has an inwardly tapering axial opening 67 normally closed by a valve member 68 having a sealing ring 69. The valve member 68 has a stem 70 guided by a guide member 71 extending from the disc 62, and the valve member is biased to the closed position by a compression spring 71. The valve body 61 has a probe 73 extending from an end face 74 that is remote from the valve, the face 74 carrying a captive sealing ring 75. The probe 73 extends through a bore in an insert 76 screwed into the threaded part 44 of the shaft 4 and having a head 77 sealing against the end of that shaft by a sealing ring 78. There is a very small clearance between the outer surface of the probe 73 and the inner surface of the insert 76, desirably from 0.010 to 0.015 mm.

The face 74 of the valve body has secured thereto by bolts 79 a disc 80 from which axially extends a boss 81 terminating in an outwardly projecting lip 82. Secured to the disc 80 by bolts such as 83 is an annular oil-collection member 84 connected at line 85 to tank T. Also secured to the disc 80 are first ends of a plurality of tension springs such as 86, the other ends of which are anchored to lugs 87 welded or otherwise secured to the bearing housing 2. The springs 86 act to bias the valve body and elements carried thereby towards the outer axial end of the shaft 4.

The end plate 64 has a flange 88 and bolts 89 secure thereto a flange 90 of an adapter 91, the confronting surface of which carries a sealing ring 92 surrounding the opening into the valve. The valve 92 has a threaded inlet 93 to which a flexible connection from the pump P may be connected to pump fluid into a chamber 94 axially aligned with the opening into the valve. A bleed connection 95 leaves from the top of the chamber 94 and may be connected through a restrictor 96 to a flexible pipe 97 leading to the tank T. A bleed opening 98 leads from the bore in the valve body and can be connected through a restrictor 99 by a pipe 100 to the header tank H.

Figure 5:
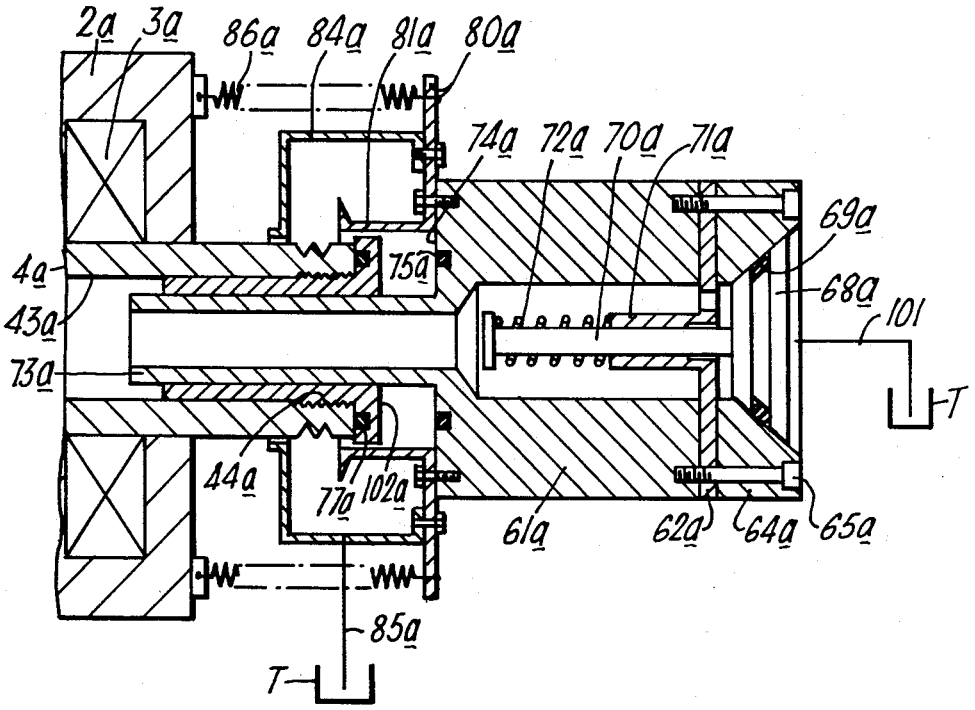

Referring now to FIG. 5 the outlet valve assembly is similar to the inlet valve assembly insofar as the valve body 61*a* and parts axially inward thereof are concerned. Again, therefore, correspondings parts are given the same reference numbers as those of FIG. 4, together with the suffix a. In this case the end member 64*a* has an outwardly tapering valve opening which is normally closed by a valve 68*a* having a sealing ring 69*a* around its periphery. The valve has a stem 70*a* passing through a guide 71*a* extending from the disc 62*a* and is biased to a closed position by a compression spring 72*a*. A suitable adapter (not shown) connects the outlet from the valve to a flexible pipe 101 connected tank T.

Operation of the system will now be described. Assume that the system has already been filled with fluid, that the carding cylinder is at rest, that there is fluid in the header tank H and that the pump P is not operating. In this condition the springs 86 will have drawn the inlet valve assembly to the right from the position shown in FIG. 4 to a location where there is contact between the face 74 of the valve body and face 102 of the insert 77. The sealing ring 75 will effect a seal between these two faces so that there can be no leakage from around the outer surface of probe 73 into the collector 84. The valve 68 is held closed on its seat by the action of the spring 72 and the header tank maintains the whole of the system under pressure. That pressure, however, is designed to be insufficient to lift the outlet valve head 68*a* off its seat, against which it is held by the spring 72*a*. The springs 86*a* hold the valve assembly to the left of the position shown in FIG. 5 where faces 74*a* and 102*a* of the valve body and the insert are in contact, sealing being effected by the sealing ring 75*a*. When it is required to operate the carding engine the pump is started to pump fluid into the chamber 94. The chamber fills and any air that may be present in the chamber escapes through the bleed opening 95 which, together with the presence of the restrictor 96 makes sure that all air is cleared from the chamber 94. Once that has occurred then the oil in chamber 94 reaches the necessary pressure, the valve 68 is opened against the action of the spring 72, fluid passing through holes in the disc 62 into the chamber of the valve body 61 against the back pressure of the fluid already present in that chamber and in the cylinder. Any air that may be present in the chamber in the valve body is exhausted through the bleed opening 98 and restrictor 99 and excess fluid may pass through the restrictor 99 to replenish the header tank H. As fluid pressure builds up the valve assembly is moved axially away from the insert 77 against the action of the springs 86. Similarly, in due course, the outlet valve assembly moves axially away from the end of the insert 77*a* and eventually the outlet valve 68*a* opens against the action of the spring 72*a* allowing fluid to exhaust to tank. Fluid circulation is thus established with air having been exhausted from the inlet valve assembly so that the fluid pathways formed by the channels within the cylinder are completely full of fluid and devoid of air bubbles. Once circulation has been established and the two valve assemblies have been moved away from the respective ends of the stub shafts rotation of the carding cylinder can commence and this can be accelerated to its working speed. The two stub shafts 4 and 4*a* with their corresponding inserts 77 and 77*a* rotate around the probes 73 and 73*a*, that rotation being allowed by the small clearance between the inserts and the probes. Small clearances are also allowed between the boss 81 and the head 77 of the insert and between the collector 84 and the outer surface of the shaft 4. Similar clearances are present at the outlet valve side. Any fluid leaking along the outer surface of the probe 73 into the space between the insert 77 and valve body 75 drips from the rim 82 into the collector 84 and thence passes to tank. A similar action occurs in relation to fluid leaking along the outer surface of the probe 73*a*. The temperature of the fluid is controlled either positively or by simple radiation from parts to which the fluid circulates, to ensure that the cylinder is maintained at its required uniform operating temperature.

When the carding engine is to be stopped fluid circulation is maintained throughout the system until the carding cylinder has come to rest at which time the pump can be stopped. Both the inlet valves and the outlet valves then close and the springs 86 and 86*a* restore the inlet and outlet valve assemblies to their locations in contact with their respective inserts 77, 77*a*. This return movement will be gradual depending on the rate of leakage from the system through the exhaust valve, through restrictor 99 and around the two probes 73, 73*a*. Once contact has been made the whole system will be maintained under pressure from the header tank H to maintain an air-free environment.

Although the principal objective of the invention is the maintenance of uniform cylinder temperature, the temperature of the bends, of the carding engine frame and of other parts of the carding engine can also advantageously be controlled by suitable use of circulating fluid. This fluid may be circulated through a jacket indicated in phantom outline as 110 on the bend 6 and a similar jacket on the bend 6*a*. One way of controlling frame temperature is to circulate fluid through a channel, for example as indicated by the phantom line 111 in FIG. 1. Such channel will extend along the frame from the bearing region of the main cylinder to at least the bearing region of the doffer, and preferably also to at least the bearing region of the takerin. Fluid paths in these regions are desirably in series with the main circulating fluid path through the cylinder channels, downstream thereof as the presence of air in such regions is not critical. By passing fluid in series through all these regions all important areas of the carding engine are maintained at the same temperature, and the card as a whole is used as a heat sink and radiator.

It will be understood that many modifications are possible from the particular arrangement shown in the drawings. Although it is preferred to have a single oil-circulating pathway within the cylinder it is possible to use two or more individual pathways so long as the fluid from those pathways passes either to a common heat exchanger or to separate heat exchangers controlling the fluid temperatures so as to be identical. Where separate axially spaced channels are used then tranfer between channels may be effected by transfer pipes or other means than the transfer channels shown. In one modified embodiment the channels are not formed by a series of annular rings, but are in the form of a continuous helical channel extending around the inner surface of the cylinder, there being an inlet into one end of the channel from the cylinder shaft at that end and an outlet from the other end of the channel into the cylinder shaft at that opposite end. In a further alternative the cylinder may have a continuous jacket on its inner surface so that substantially the whole of the cylinder surface may be contacted by fluid. In this arrangement the jacket will desirably incorporate baffles that define a continuous passage for the flow of fluid. Any fluid-carrying jacket associated with the bend may similarly be divided, and in particular may have baffles defining a continuous labyrinthine passage extending over the whole area of the bend. As an alternative to circumferentially extending paths for the fluid, such paths may extend axially, transfer between adjacent paths occuring at theends of the cylinder.

Balancing of the cylinder may be effected in a manner differing from that suggested. Furthermore, the sealing of the system when at rest in order to maintain the cylinder passages full of oil may differ from that described and in particular rather than use a header tank may rely on a Torricelli vacuum effect where the probes 73 and 73*a* leave their respective stub shafts. Methods of supplying oil through stub shafts other than the probes illustrated can also be utilised, and the shaft and probe arrangement can of course be used in inverse form to that shown, the shaft carrying or constituting the probe.

The fluid used for circulation purposes is desirably a lubricating oil that is of sufficient viscosity to entrain and move air with the oil. The speed at which the fluid is caused to travel through the channels should also be high enough to ensure that air is swept with the fluid. Both these factors assist in ensuring that the system is freed of air during the initial filling process, after which it is kept air-free by the bleed arrangements and valve assemblies as described.

I claim:

1. A carding engine having a hollow carding cylinder, means mounting said cylinder for rotation about a substantially horizontal axis, and bends at each side of the cylinder, in which a fluid-conveying pathway is formed on the inner surface of the cylinder in a pattern such that fluid circulated through the pathway will maintain the surface temperature of the cylinder substantially uniform, the pathway forming at least one continuous fluid path having a discrete inlet and a discrete outlet at opposite extremities thereof.

2. A carding engine according to claim 1 in which the pathway is in the form of a single continuous fluid path.

3. A carding engine according to claim 1 in which the pathway is formed by a plurality of parallel, axially spaced channels each extending around the full inner circumference of the cylinder.

4. A carding engine according to claim 2 in which the pathway is formed by a plurality of parallel, axially spaced channels each extending around the full inner circumference of the cylinder, each channel is interrupted by a baffle extending transversely of the channel, an inlet and outlet for each channel are provided at opposite sides of the baffle and immediately adjacent thereto, and transfer means are provided between the outlet from one channel and the inlet into a next adjacent channel.

5. A carding engine according to claim 4 in which the transfer means are transfer channels extending between adjacent ones of said channels axially of the cylinder.

6. A carding engine according to claim 1 in which the cylinder is provided with means whereby balance weights may be detachably mounted on the cylinder at selected angular locations thereto.

7. A carding engine according to claim 1 and including means for circulating fluid through the pathway.

8. A carding engine according to claim 7 in which the circulating means, the fluid and the pathway are such that, during operation, the pathway is maintained full of fluid.

9. A carding engine according to claim 7 in which the cylinder is mounted at each end thereof on a shaft which is rotatably supported by bearing means, fluid is supplied to the pathway through an axial bore in the shaft at a first end of the cylinder and fluid is exhausted from the pathway through an axial bore in a shaft at the second end of the cylinder.

10. A carding engine according to claim 9 in which the shaft at each end of the cylinder has associated therewith a valve to prevent fluid leaking from the shaft.

11. A carding engine according to claim 10 in which the shaft at each end of the cylinder has a stationary probe extending axially into the bore thereof, the probe having a fluid channel therethrough, and the clearance between the outer diameter of the probe and the inner diameter of the bore of the shaft and the extent of the probe into the bore are such as to limit leakage of fluid from the bore.

12. A carding engine according to claim 11 in which each valve is a non-return valve, each probe is carried by a housing of an associated one of the non-return valves which control flow of fluid into or from the probe, means are provided for resiliently biasing the housing towards the adjacent axial end of the respective shaft and means are provided for effecting a seal between a face of the housing and the adjacent axial end of the respective shaft when these are in contact.

13. A carding engine according to claim 12 in which the housing of the fluid inlet non-return valve includes a bleed passage between the valve and the probe.

14. A carding engine according to claim 13 in which the bleed passage is connected through a flow restrictor to a fluid header tank.

* * * * *